US010407227B2

(12) United States Patent
Ikeda

(10) Patent No.: US 10,407,227 B2
(45) Date of Patent: Sep. 10, 2019

(54) CARTON, BLANK THEREFOR AND PACKAGE

(71) Applicant: WestRock Packaging Systems, LLC, Norcross, GA (US)

(72) Inventor: Tamio Ikeda, Kawasaki (JP)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 15/541,958

(22) PCT Filed: Jan. 7, 2016

(86) PCT No.: PCT/US2016/012406

§ 371 (c)(1),
(2) Date: Jul. 6, 2017

(87) PCT Pub. No.: WO2016/112145

PCT Pub. Date: Jul. 14, 2016

(65) Prior Publication Data

US 2018/0016074 A1 Jan. 18, 2018

(30) Foreign Application Priority Data

Jan. 7, 2015 (JP) ..... 2015-001383

(51) Int. Cl.
*B65D 71/20* (2006.01)
*B65D 5/04* (2006.01)

(52) U.S. Cl.
CPC ..... *B65D 71/20* (2013.01); *B65D 5/04* (2013.01)

(58) Field of Classification Search
CPC ..... B65D 71/20; B65D 5/04
See application file for complete search history.

(56) References Cited

U.S. PATENT DOCUMENTS

| | | | | |
|---|---|---|---|---|
| 9,174,784 | B2 * | 11/2015 | Bakx | B65D 71/14 |
| 9,211,986 | B2 * | 12/2015 | Auclair | B65D 71/22 |
| 9,376,250 | B2 | 6/2016 | Spivey, Sr. | |
| 9,387,968 | B2 * | 7/2016 | Zammit | B65D 71/18 |
| 9,708,112 | B2 * | 7/2017 | Sutherland | B65D 71/20 |
| 10,053,271 | B2 * | 8/2018 | Psalidas | B65D 71/22 |

FOREIGN PATENT DOCUMENTS

| | | | | |
|---|---|---|---|---|
| FR | 2088698 | A5 | 1/1972 | |
| FR | 2488857 | A3 | 2/1982 | |
| WO | WO 0234639 | A1 * | 5/2002 | B65D 71/20 |
| WO | WO2005/123533 | A1 | 12/2005 | |
| WO | WO2012/155024 | A2 | 11/2012 | |

* cited by examiner

*Primary Examiner* — Corey N Skurdal
(74) *Attorney, Agent, or Firm* — WestRock Intellectual Property Group

(57) ABSTRACT

A carrier includes first and second opposed side walls (16, 20), a bottom wall (12, 24) and a top wall (18). The carrier has an article retention device (L1, L2, L3, L4, L5, L6) for retaining a portion of an article (C) within the carrier. The article retention device is formed in part from the bottom wall and in part from the first side wall. The article retention device includes an anchor tab (52) for engaging with an article and at least one protection flap (56, 58) for protecting the article. The anchor tab and the protection flap define an opening in the carrier through which a portion of the article protrudes.

19 Claims, 9 Drawing Sheets

CARTON, BLANK THEREFOR AND PACKAGE

CROSS-REFERENCE TO RELATED APPLICATIONS

This application is a National Phase application of PCT Application PCT/US2016/012406, filed Jan. 7, 2016, which claims the benefit of Japanese Patent Application No. 002015-1383, filed Jan. 7, 2015, which is incorporated herein by reference in its entirety.

FIELD OF THE INVENTION

The present invention relates to a carrier of the wraparound type for forming a consumer package comprising a grouped arrangement of articles and more specifically, but not exclusively, to a carrier comprising an article retaining device.

BACKGROUND OF THE INVENTION

In the field of packaging it is often required to provide consumers with a package comprising multiple primary product containers. Such multi-packs are desirable for shipping and distribution and for display of promotional information. Wraparound style carriers are known in which a prepared blank sheet of material is placed on top of a grouped arrangement of articles, such as bottles; the blank is then folded and tightly wrapped about the grouped arrangement of articles and a composite bottom wall structure is constructed for holding the assembled wraparound carrier tightly about the grouped arrangement of articles. A handle or carrying means is typically provided in a top panel of the carrier so that the package (carrier and grouped articles) can be conveniently lifted by a consumer for purchase and transport home. Side panels of the carrier provide areas for the high-quality printing of branding graphics and other advertising and promotional indicia.

It is desirable for wraparound carriers to securely retain the grouped arrangement of articles. If the carrier is not tightly wrapped around the group, or if articles are able to move within the carrier, then the integrity of the package can become compromised and the package may fail with the result that articles fall out and could break.

It is also desirable if wraparound carriers can be assembled on existing automatic machines such that no alteration or no significant alteration of existing automatic machines is required.

For cost and environmental considerations, it is preferable if such carriers are formed from as little material as possible and cause as little wastage in the materials from which they are formed as possible. Another consideration is the strength of the packaging and its suitability for holding and transporting large weights of articles.

The present invention seeks to provide a new carrier that is an improvement or an alternative to known wraparound carriers.

SUMMARY OF INVENTION

According to a first aspect of the present invention there is provided a carrier comprising first and second opposed side walls, a bottom wall and a top wall. The carrier comprises at least one article retention device for retaining a portion of an article within the carrier. The at least one article retention device is formed in part from the bottom wall and in part from the first side wall. The at least one article retention device comprises an anchor tab for engaging with an article and at least one protection flap for protecting the article. The anchor tab and the protection flap may define an opening in the carrier through which a portion of the article may protrude.

Optionally, the anchor tab is hingedly connected to the bottom wall.

Optionally, the anchor tab comprises an anchor flap hingedly connected thereto.

In some embodiments, the carrier comprises a first bevel panel disposed between the first side wall and the bottom wall, and the article retention device is struck at least in part from the first bevel panel.

Optionally, the at least one protection tab is struck in part from the first bevel panel and in part from the first side wall.

In some embodiments, the article retention device comprises three protection flaps, the first and second protection flaps hinged in opposition to each other on opposed sides of a third protection flap.

Optionally, the third protection flap is arranged perpendicularly with respect to the first and second protection flaps.

Optionally, the carrier comprises a first bevel panel disposed between the first side wall and the bottom wall, and the article retention device is struck at least in part from the first bevel panel.

The at least one protection tab may be folded outwardly in response to receiving an article in the article retention device.

Optionally, the anchor tab is hingedly connected to the bottom wall by a non-linear fold line.

In some embodiments, the non-linear fold line is arcuate in shape.

Optionally, the carrier is of the wraparound type and comprises a composite bottom wall and the top wall is foldably adjoined to each of the first and second opposed side walls and formed from a single panel of material.

According to a second aspect of the present invention there is provided a blank for forming a carrier comprising panels for forming a first side wall and a second opposed side wall, a bottom wall and a top wall. The blank comprises at least one article retention device for retaining a portion of an article. The at least one article retention device is formed in part from the panel forming the bottom wall and in part from the panel forming the first side wall. The at least one article retention device comprises an anchor tab for engaging with an article and at least one protection flap for protecting the article. The anchor tab and the protection flap may define an opening through which a portion of the article may protrude when the blank is assembled into the carrier and loaded with articles.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS OF THE PRESENT INVENTION

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the terms "carton" and "carrier" refer, for the non-limiting purpose of illustrating the various features of the invention, to a container for engaging and carrying articles, such as product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like. Optionally, the carrier of the embodiments detailed herein is beneficially used for enclosing and retaining articles, such as bottles, having a top closure or top cap having a pull-ring or other opening device integrally associated therewith.

Figures 1, 1A:
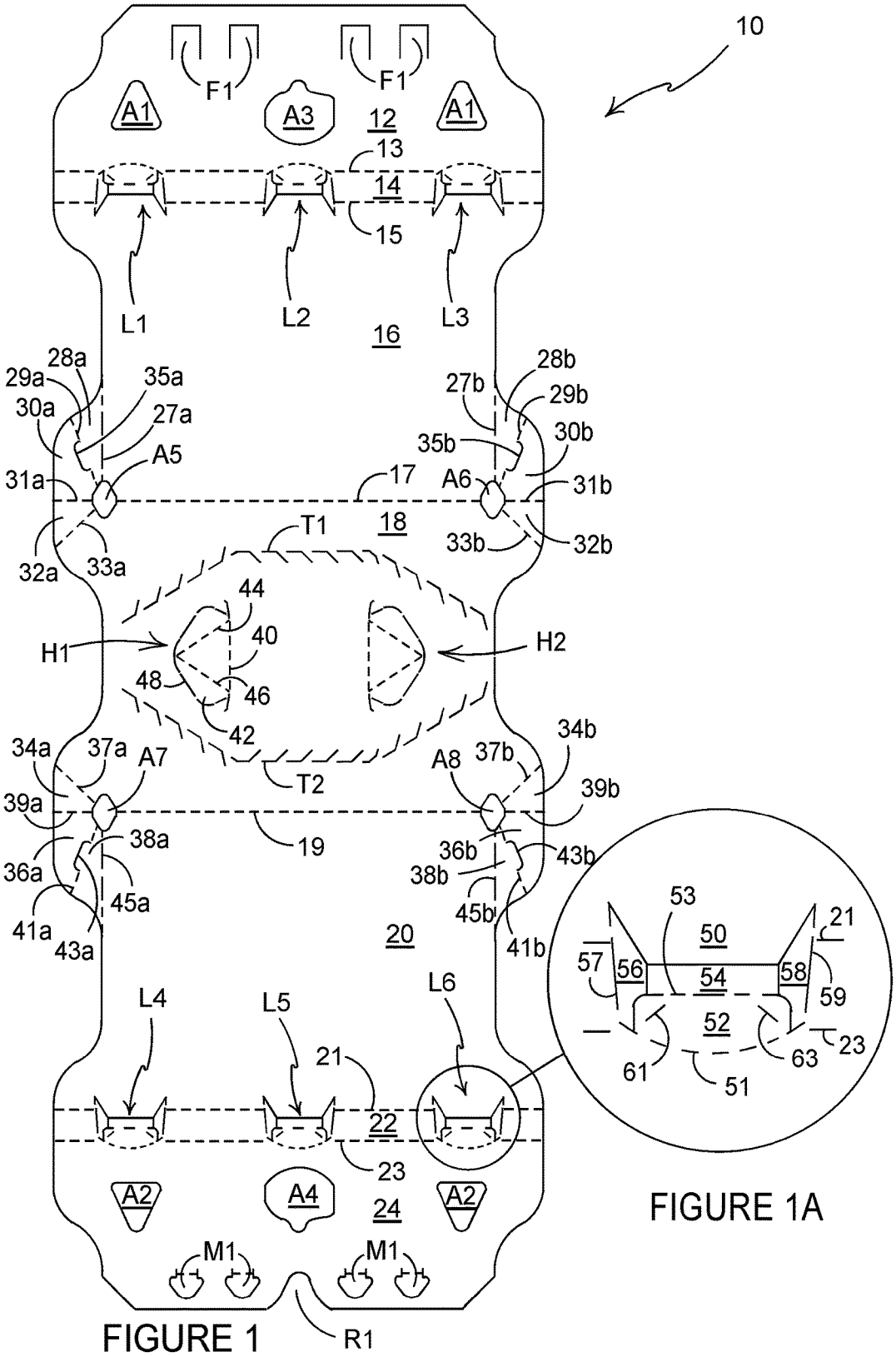
FIG. 1 is a plan view of a blank for forming a carrier of the wraparound style according to a first embodiment of the invention.
FIG. 1A is an enlarged view of a retention device provided in the blank of FIG. 1.

Referring to FIG. 1, there is shown a blank 10 for forming a wraparound carrier 90 (see FIGS. 2 to 6). The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed where suitable, for example, to provide the carrier structure described in more detail below.

In the exemplary embodiment, the blank 10 is configured to form a carrier 90 for packaging an exemplary arrangement of exemplary articles 'C'. In a first illustrated exemplary embodiment, the arrangement is a 3×2 matrix and the articles are cans 'C', each having a chime or bevel at the base and/or top. The cans 'C' may comprise an integral pull-tab or stay-on tab type access device. In other embodiments, the blank 10 is alternatively configured to form a carrier for packaging other types, number and size of article and/or for packaging articles in a different number, arrangement or configuration.

As can be seen in FIG. 1, the blank 10 comprises a series of primary panels 12, 14, 16, 18, 20, 22, 24 which includes a first bottom panel 12, an optional first bevel panel 14, a first side panel 16, a top panel 18, a second side panel 20, an optional second bevel panel 22 and a second bottom panel 24. The primary panels 12, 14, 16, 18, 20, 22, 24 are hinged one to the next in series by longitudinally extending fold lines 13, 15, 17, 19, 21 and 23.

The first and second bottom panels 12, 24 comprise first and second parts F1, M1 respectively of a mechanical locking mechanism F1/M1 that serves to mechanically join the first bottom panel 12 to the second bottom panel 24 when the blank 10 is folded and formed into a carrier 90 so as to form a composite bottom wall structure 12/24. The illustrated first and second parts F1, M1 of the mechanical locking mechanism F1/M1 are known in the art. However, it will be recognised that the mechanical locking mechanism is optional, and in other arrangements and embodiments may be substituted with a different type of mechanical locking mechanism and/or may be substituted with a different type of locking or interlocking feature, for example adhesive or tape. Furthermore, in other arrangements, the composite bottom wall structure may be formed from panels of differing size and/or may be formed differently from that shown herein. The provision of a composite bottom wall structure enables the carrier 90, when formed, to be tightly wrapped around an organised group of articles and to tightly pack those articles within the carrier 90. In this way, the carrier 90 can securely contain the group of articles without having to fully enclose the group of articles, for example, by providing end walls.

Optionally, the blank 10 may also comprise a plurality of apertures A1, A2, A3, A4 for facilitating alignment and assembly of the carrier 90. A pair of first apertures A1 is provided in the first bottom panel 12. Each of the pair of first apertures A1 is substantially triangular in shape. A pair of second apertures A2 is provided in the second bottom panel 24. Each of the pair of second apertures A2 is substantially triangular in shape. A third aperture A3 is provided in the first bottom panel 12. A fourth aperture A4 is provided in the second bottom panel 24.

An optional recess R1 is struck from a free end edge of the second bottom panel 24. The free end edge is opposite the fold line 23 between the second bottom panel 24 and the second bevel panel 22. The recess R1 may also be utilised to facilitate alignment and assembly of the carrier 90.

The blank 10 may also comprise a carrier opening device T1/T2, which is optionally provided in the top panel 18 and which is optionally formed as a pair of tear lines T1, T2 which define a tear strip therebetween. In other embodiments it is anticipated that the optional carrier opening device T1/T2 may be omitted entirely, or the carrier opening device T1/T2 may take a different form, size, shape and/or position to that shown herein, and/or more than one carrier opening device T1/T2 may be provided.

The blank 10 may also comprise a carrying device H1/H2 provided in the top panel 18. In this arrangement the carrying device H1/H2 comprises two oppositely positioned and similarly sized and formed finger tabs 42, which are defined by a generally semi-circular cut (or weakened) line 48 and a hinge line 40. The finger tabs 42 may comprise optional fold lines 44, 46 for facilitating folding of the finger tabs 42 inwardly of the carrier 90. The finger tabs 42 can be pressed inwardly of the top panel 18 and provide a simple means by which a user of the carrier 90 can grasp or grip the carrier 90 for lifting and transporting the carrier 90. In other embodiments it is anticipated that the optional carrying device H1/H2 may be omitted entirely, or may take a different form, size, shape and/or position to that shown herein, and/or more than one carrying device H1/H2 may be provided.

The blank 10 may also comprise end closure panels. In the illustrated embodiment a first end closure panel 32*a* and a second end closure panel 34*a* are hingedly connected to a first side edge of the top panel 18. A third end closure panel 32*b* and a fourth end closure panel 34*b* are hingedly connected to a second side edge of the top panel 18. Each of the first, second, third and fourth end closure panels 32*a*, 32*b*, 34*a*, 34*b* at least partially close a respective open end of a tubular structure formed by the plurality of primary panels 12, 14, 16, 18, 20, 22, 24.

The first end closure panel 32*a* is hinged to the top panel 18 by a fold line 33*a*. The first end closure panel 32*a* is hinged to a first web panel 30*a* by a fold line 31*a*. The first web panel 30*a* is hinged to a first anchor panel 28*a* by a fold line 29*a*. The fold line 29*a* is interrupted by a cut line 35*a*. Optionally, outline 35*a* is substantially "U" shaped. The first anchor panel 28*a* is hingedly connected to the first side panel 16 by a fold line 27*a*. An aperture A5 is struck from the blank 10. The aperture A5 is struck in part from the first side panel 16, the top panel 18, the first anchor panel 28*a*, the first web panel 30*a* and the first end closure panel 32*a*.

The second end closure panel 34*a* is hinged to the top panel 18 by a fold line 37*a*. The second end closure panel 34*a* is hinged to a second web panel 36*a* by a fold line 39*a*. The second web panel 36*a* is hinged to a second anchor panel 38*a* by a fold line 41*a*. The fold line 41*a* is interrupted by a cut line 43*a*. Optionally, cut line 43*a* is substantially "U" shaped. The second anchor panel 38*a* is hingedly connected to the second side panel 20 by a fold line 45*a*. An aperture A7 is struck from the blank 10. The aperture A7 is struck in part from the second side panel 20, the top panel 18, the second anchor panel 38*a*, the second web panel 36*a* and the second end closure panel 34*a*.

The third end closure panel 32*b* is hinged to the top panel 18 by a fold line 33*b*. The third end closure panel 32*b* is hinged to a third web panel 30*b* by a fold line 31*b*. The third web panel 30*b* is hinged to a third anchor panel 28*b* by a fold line 29*b*. The fold line 29*b* is interrupted by a cut line 35*b*. Optionally, cut line 35*b* is substantially "U" shaped. The third anchor panel 28*b* is hingedly connected to the first side panel 16 by a fold line 27*b*. An aperture A6 is struck from the blank 10. The aperture A6 is struck in part from the first side panel 16, the top panel 18, the third anchor panel 28*b*, the third web panel 30*b* and the third end closure panel 32*b*.

The fourth end closure panel 34*b* is hinged to the top panel 18 by a fold line 37*b*. The fourth end closure panel 34*b* is hinged to a fourth web panel 36*b* by a fold line 39*b*. The fourth web panel 36*b* is hinged to a fourth anchor panel 38*b* by a fold line 41*b*. The fold line 41*b* is interrupted by a cut line 43*b*. Optionally, cut line 43*b* is substantially "U" shaped. The fourth anchor panel 38*b* is hingedly connected to the second side panel 20 by a fold line 45*b*. An aperture A8 is struck from the blank 10. The aperture A8 is struck in part from the second side panel 20, the top panel 18, the fourth anchor panel 38*b*, the fourth web panel 36*b* and the fourth end closure panel 34*b*.

The blank 10 also comprises article retention devices L1, L2, L3, L4, L5, L6 for engaging with a bottom of an article 'C'. In the optional arrangement where the blank 10 is configured for forming a carrier 90 for holding six articles in two rows of three articles each, three article retention devices L1, L2, L3 are provided along the first bevel panel 14 between the first bottom panel 12 and the first side panel 16; and a further three article retention devices L4, L5, L6 are provided along the second bevel panel 22 between the second bottom panel 24 and the second side panel 20.

Each article retention device L1, L2, L3, L4, L5, L6 is substantially the same in construction. The article retention devices L1, L2, L3, L4, L5, L6 will be described by reference to the sixth article retention device L6, an enlarged view of which is shown in FIG. 1A.

The sixth article retention device L6 comprises a protection tab 50 and a pair of foldable flaps 56, 58 (also referred to as protection flaps) which help to protect the heel or bottom portion of an article 'C' when partially disposed within an opening formed in part by displacement of the protection tab 50 and the pair of foldable flaps 56, 58. The protection tab 50 and each flap 56, 58 of the pair of foldable flaps 56, 58 are folded outwardly when an article 'C' is received by the sixth article retention device L6. A first foldable flap 56 of the pair is hinged to the second bevel panel 22 and to the second side panel 20 by a fold line 57. A second foldable flap 58 of the pair is hinged to the second bevel panel 22 and to the second side panel 20 by a fold line 59. An anchor tab 52 is hinged to the second bottom panel 24 by a fold line 51. Optionally, fold line 51 is arcuate in shape; the curved or arcuate shape of the fold line 51 serves to increase the resilient bias of the anchor tab 52 to return to the plane of the second bottom panel 24. In this way the anchor tab 52 is biased against the base of the article 'C' when the article retention device L6 is in use. An optional anchor flap 54 is hinged to the anchor tab 52 by a fold line 53. The anchor flap 54 is foldable with respect to the anchor tab 52 such that a surface of the anchor flap 54 can be disposed in contact with the base of an article 'C' received by the sixth article retention device L6. The anchor tab 52 may comprise optional fold lines 61, 63 for facilitating folding of the anchor tab 52 into or about the base of the article 'C' received by the article retention device L6. In the illustrated embodiment fold lines 61, 63 are defined by cut lines. The anchor flap 54 is optionally separated from the protection tab 50 by a weakened line or cut line, such that in blank form, there is no gap between the protection tab 50 and anchor flap 54.

Turning to the construction of the carrier 90 as illustrated in FIGS. 2 to 6, the carrier 90 can be formed by a series of sequential folding operations in a straight line machine so that the carrier 90 is not required to be rotated or inverted to complete its construction. The folding process is not limited to that described below and may be altered according to particular manufacturing requirements.

Fold lines 13, 15, 17, 19, 21 and 23 may be pre-creased or pre-broken to facilitate assembly of the blank 10 into the carrier 90.

The pre-creased blank 10 may be placed on top of an assembled group of six articles 'C' disposed in a tightly packed side-by-side arrangement of two rows of three articles 'C' each. The top panel 18 is placed in overlying contact with the tops of the articles 'C'. The first and second side panels 16, 20 are folded downwardly about fold lines 17, 19. The first and second side panels 16, 20 are brought into face contacting relationship with the sides of the articles 'C' in the group.

The first and second bevel panels 14, 22 are folded about fold lines 15, 21 and folded about the chimes $C_M$ of each of the articles 'C'.

The first and second bottom panels 12, 24 are folded about fold lines 13, 23 respectively and brought into overlapping relationship with one another. Once the first and second bottom panels 12, 24 appropriately overlap then the mechanical locking mechanism M1/F1 is deployed to affix the first and second bottom panels 12, 24 together and thus complete the formation of a tightly wrapped carrier 90 about the group of six articles 'C'.

The end closure panels 32*a*, 32*b*, 34*a*, 34*b* are folded to partially close the tubular structure formed by the plurality of primary panels 12, 14, 16, 18, 20, 22, 24. The anchor panels 28*a*, 28*b*, 38*a*, 38*b* are each folded into face contacting relationship with the respective one of the first or second side panels 16, 20 to which they are hinged. In response to folding the anchor panels 28*a*, 28*b*, 38*a*, 38*b*, the web panels 30*a*, 30*b*, 36*a*, 36*b* and the end closure panels 32*a*, 32*b*, 34*a*, 34*b* are folded into position partially closing the open ends of the tubular structure. Each of the end closure panels 32*a*, 32*b*, 34*a*, 34*b* engages with an endmost article 'C' in the carrier 90 so as to retain an upper end of a respective one of the endmost articles 'C'.

An article 'C' is received in each of the article retention devices L1, L2, L3, L4, L5, L6. The pair of foldable flaps 56, 58 and the protection tab 50 are displaced outwardly of the carrier 90 by a portion of a respective article 'C'. The anchor tab 52 and the anchor flap 54 are folded inwardly of the carrier 90, for example by a machine tool pressing against the anchor tab 52.

Figure 2:
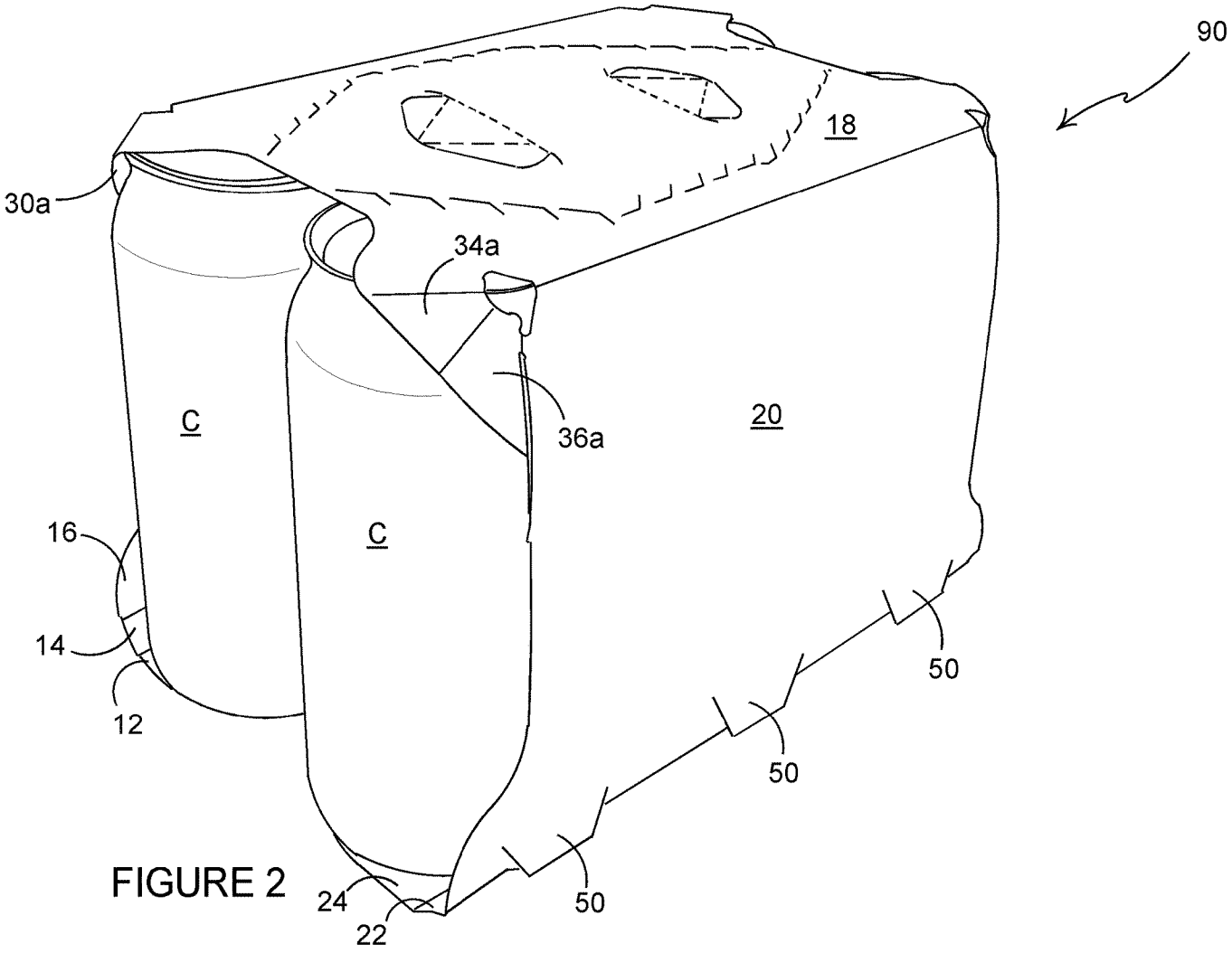
FIG. 2 is a perspective view from above of a package comprising a carrier formed from the blank of FIG. 1 and a grouped arrangement of articles secured therein.
Figure 3:
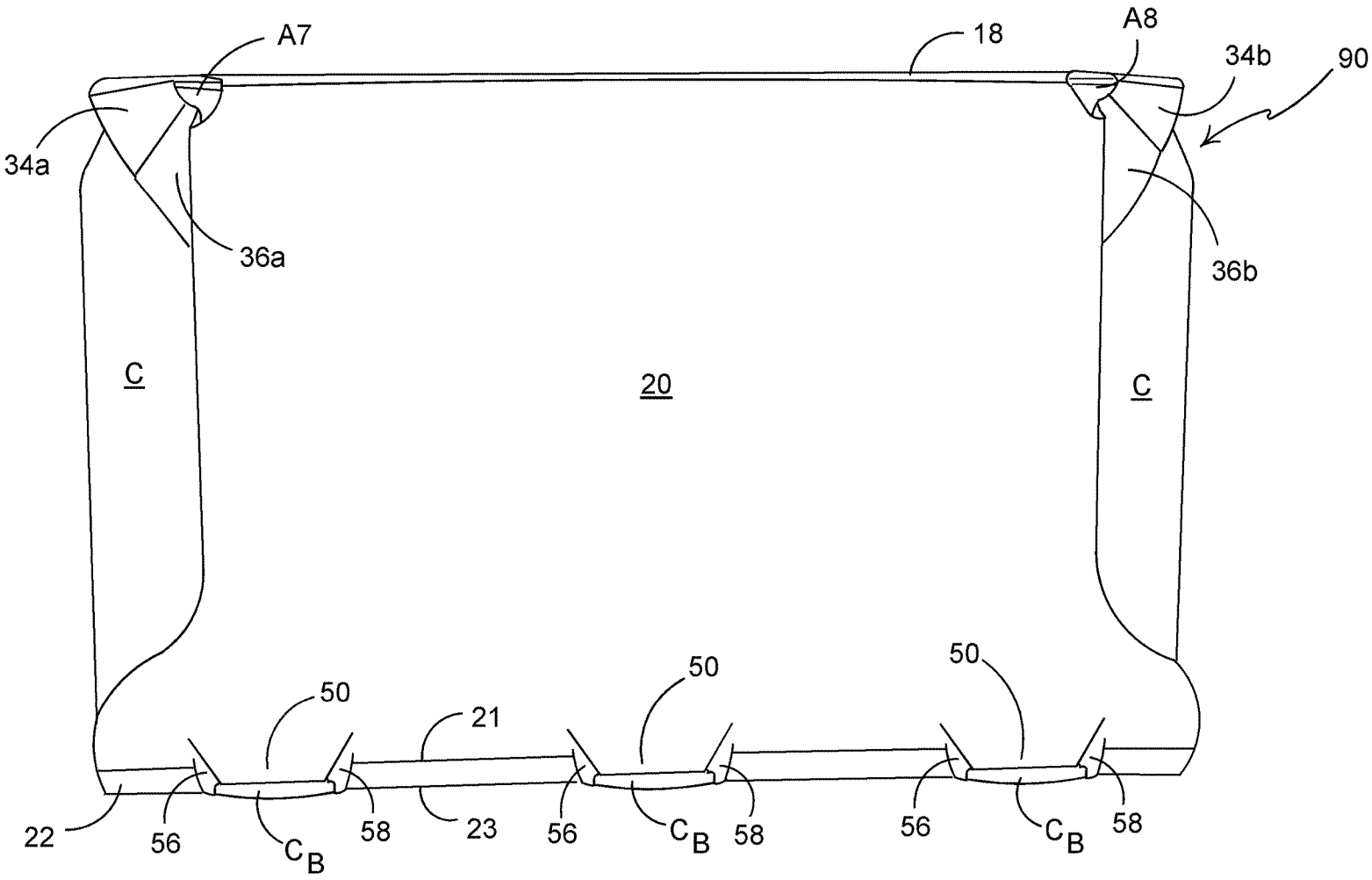
FIG. 3 is a side view of the package of FIG. 2.
Figure 4:
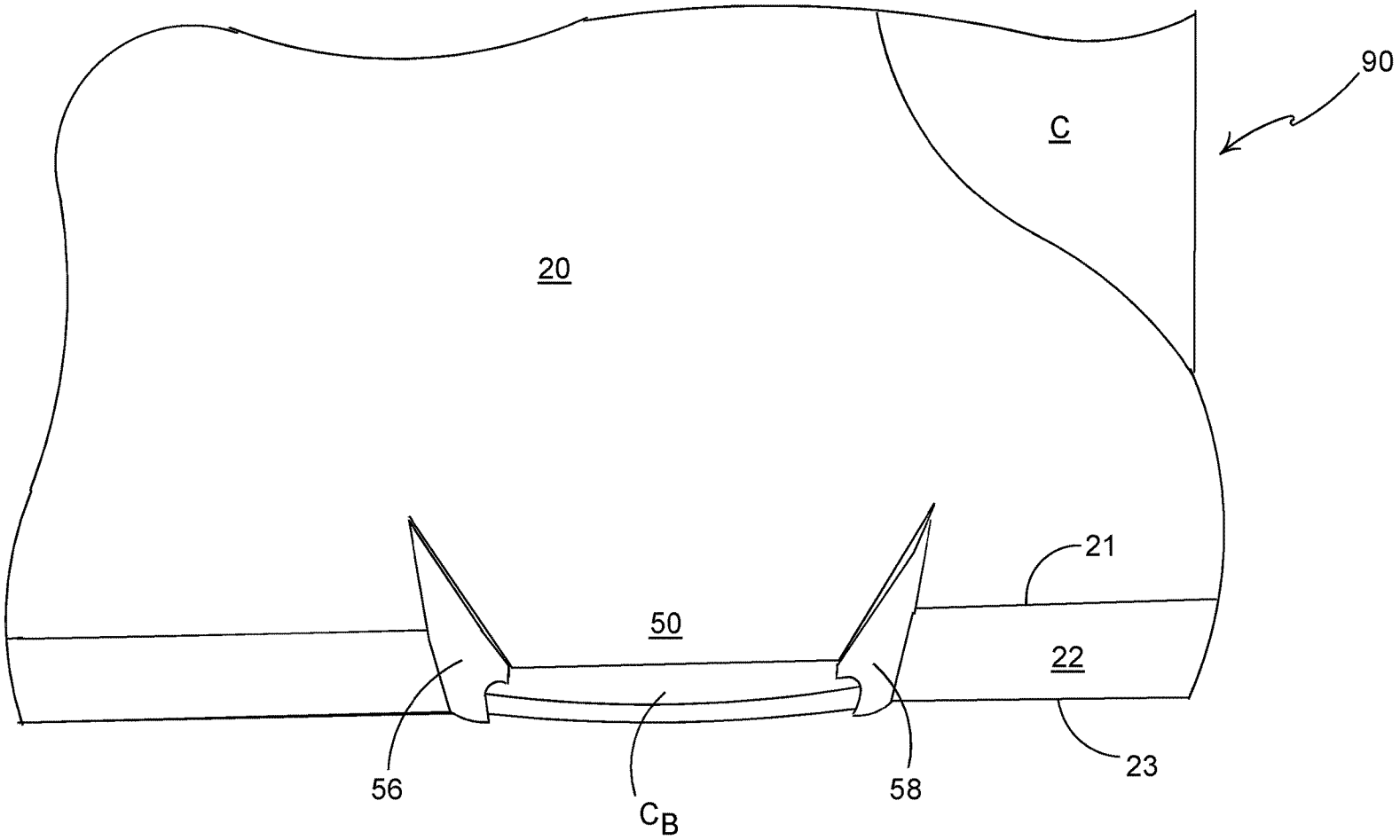
FIG. 4 is an enlarged view of part of the package shown in FIG. 3.

The completed package is shown in FIGS. 2 and 3. The pair of foldable flaps 56, 58 and the protection tab 50 extend about a portion of an article 'C' which protrudes through an opening in the carrier 90 formed by displacement of the pair of foldable flaps 56, 58, the protection tab 50 and the anchor tab 52.

The pair of foldable flaps 56, 58, the protection tab 50, the anchor tab 52 and the anchor flap 54 completely define an opening in the carrier 90. That is to say the article retention devices L1, L2, L3, L4, L5, L6, when in an unfolded state in the blank 10, do not reveal but close an opening (such as an aperture or cutaway) that is defined in the blank 10 by the pair of foldable flaps 56, 58, the protection tab 50, the anchor tab 52 and the anchor flap 54. In this way there is no scrap or waste material created as a consequence of providing the article retention devices L1, L2, L3, L4, L5, L6. This is advantageous since such scrap material could interfere with the assembly of the carrier 90, in particular becoming trapped in machinery automating the construction of the blank 10 into a carrier 90 about a group of articles 'C'. For example such scrap material could lead to the misfeeding of blanks 10 from a hopper causing two or more blanks 10 to become entangled.

Figure 5:
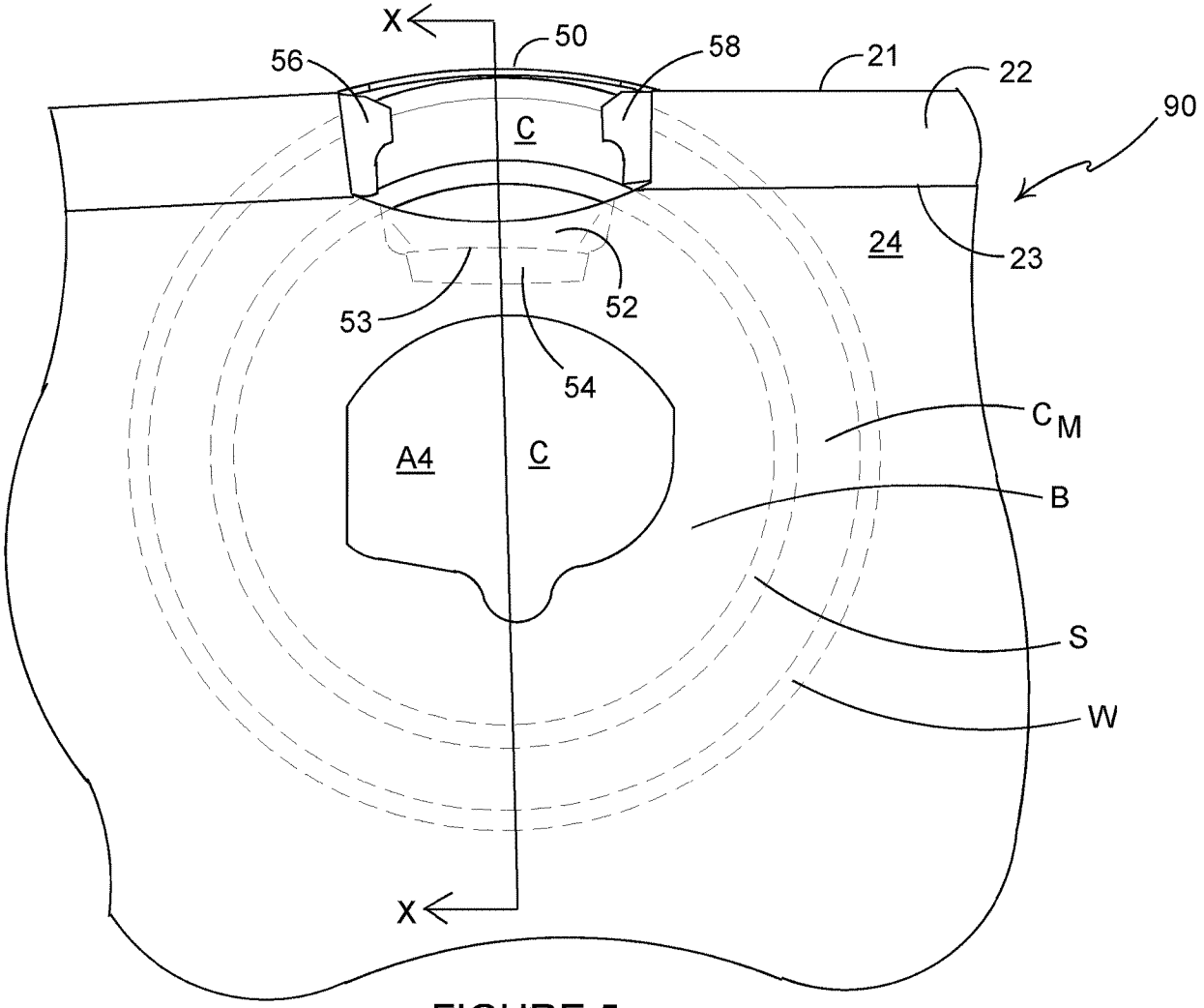
FIG. 5 is a bottom view of a portion of the package of FIG. 2, wherein parts of an article obscured from view by the bottom of the package are shown in dotted outline for illustrative purposes.

FIG. 5 shows a view from below of a portion of the carrier 90. The article 'C' is visible through an opening created by folding the anchor tab 52 and the anchor flap 54 into the carrier 90. The article 'C' comprises a chime $C_M$ between a side wall W of the article 'C' and a base B. The base B is indented and substantially dish shaped; a ridge around the base B forms a seat S upon which the article 'C' rests. The anchor tab 52 and anchor flap 54 have been folded about the fold line 51 so as to be disposed in the base B of the article C.

Figure 6:
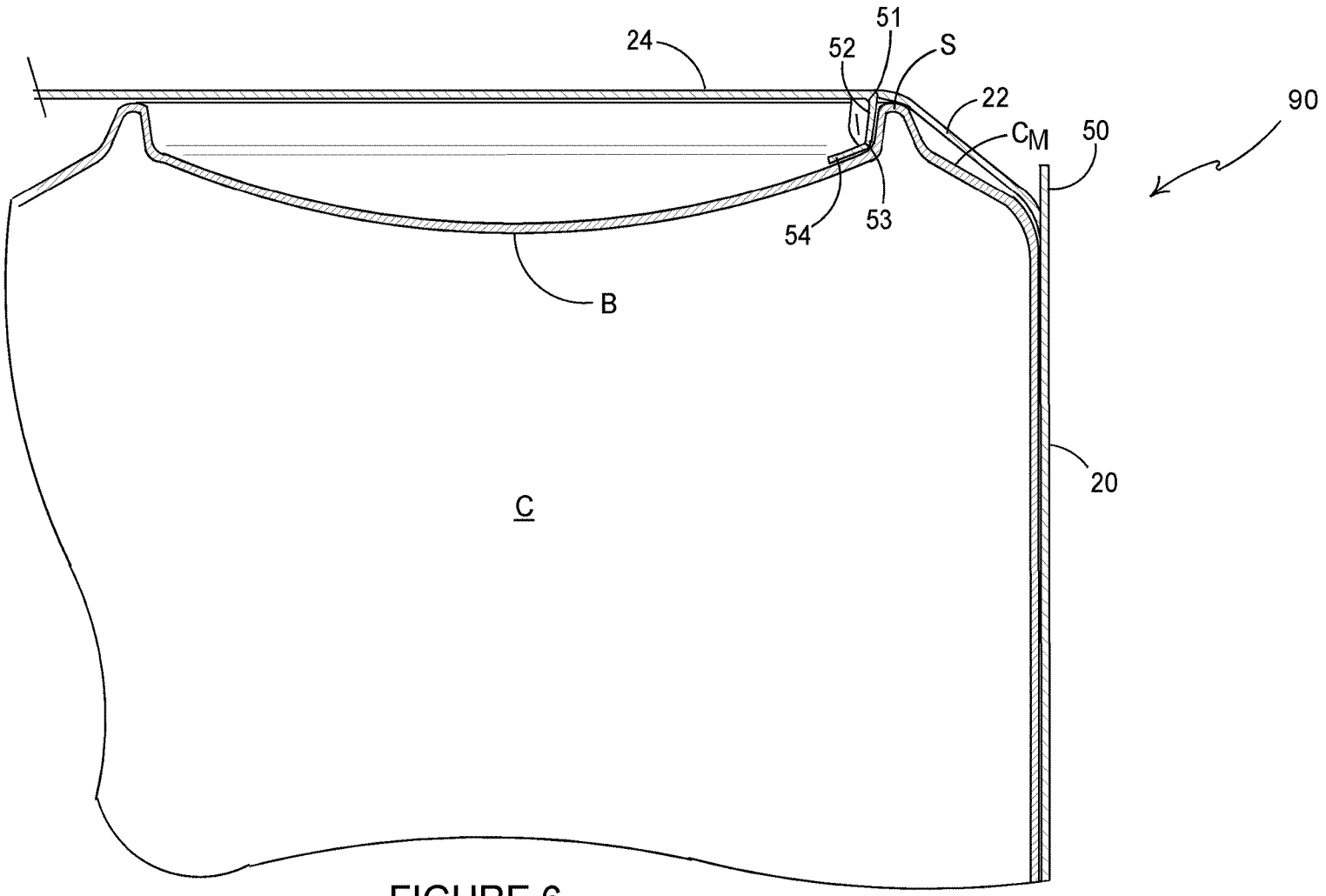
FIG. 6 is a sectional view along the line x-x shown in FIG. 5.

FIG. 6 shows a view along the line X-X in the direction indicated in FIG. 5. The bowl or dish shape of the base B is clearly visible. The ridge of the article 'C' forms an edge against which the anchor tab 52 can bear. The anchor flap 54 is folded about the fold line 53 such that an outer surface is in face contacting relationship with the base B. The protection tab 50 can be seen to extend from the second side wall 20 about the chime $C_M$. The second bevel panel 22 is folded about the chime $C_M$. In this way the article retention devices L1, L2, L3, L4, L5, L6 secure the articles 'C' within the carrier 90 and protect the articles 'C'.

The anchor flap 54 is folded about the fold line 53 so as to extend from the anchor tab 52 towards the centre of the carrier 90; that is to say the anchor flap 54 extends away from the opening created by folding the anchor tab 52. In this way the anchor tab 52 can bear against an edge or side wall of the base B of the article 'C' as shown in FIG. 6. The anchor flap 54 is disposed over a portion of the base panel 24 when the carrier 90 is placed at rest upon the composite base wall 12/24 formed from the first and second base panels 12, 24.

Figures 7, 7A:
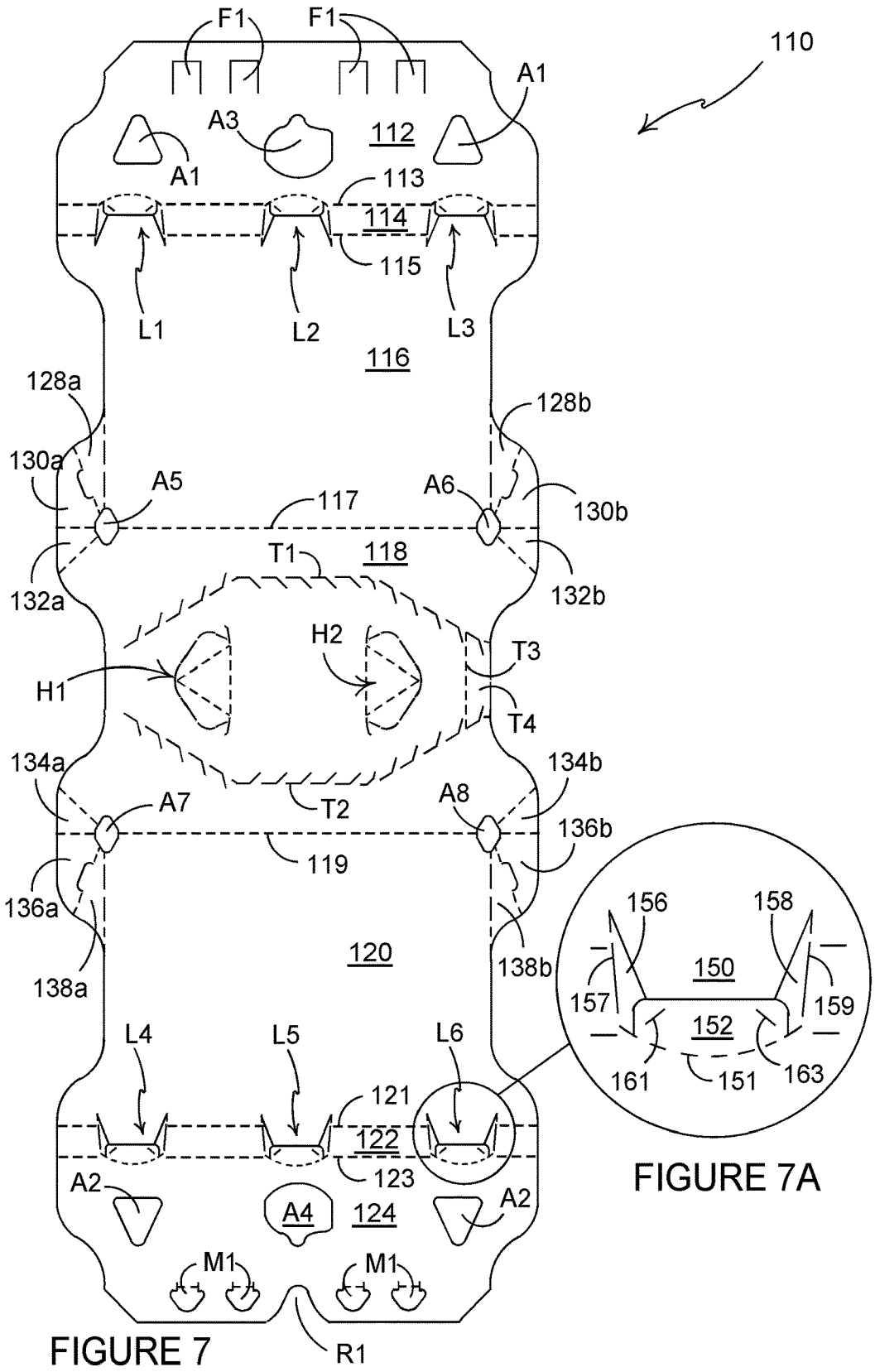
FIG. 7 is a plan view of a blank for forming a carrier of the wraparound style according to a second embodiment of the invention.
FIG. 7A is an enlarged view of a retention device provided in the blank of FIG. 7.
Figure 8:
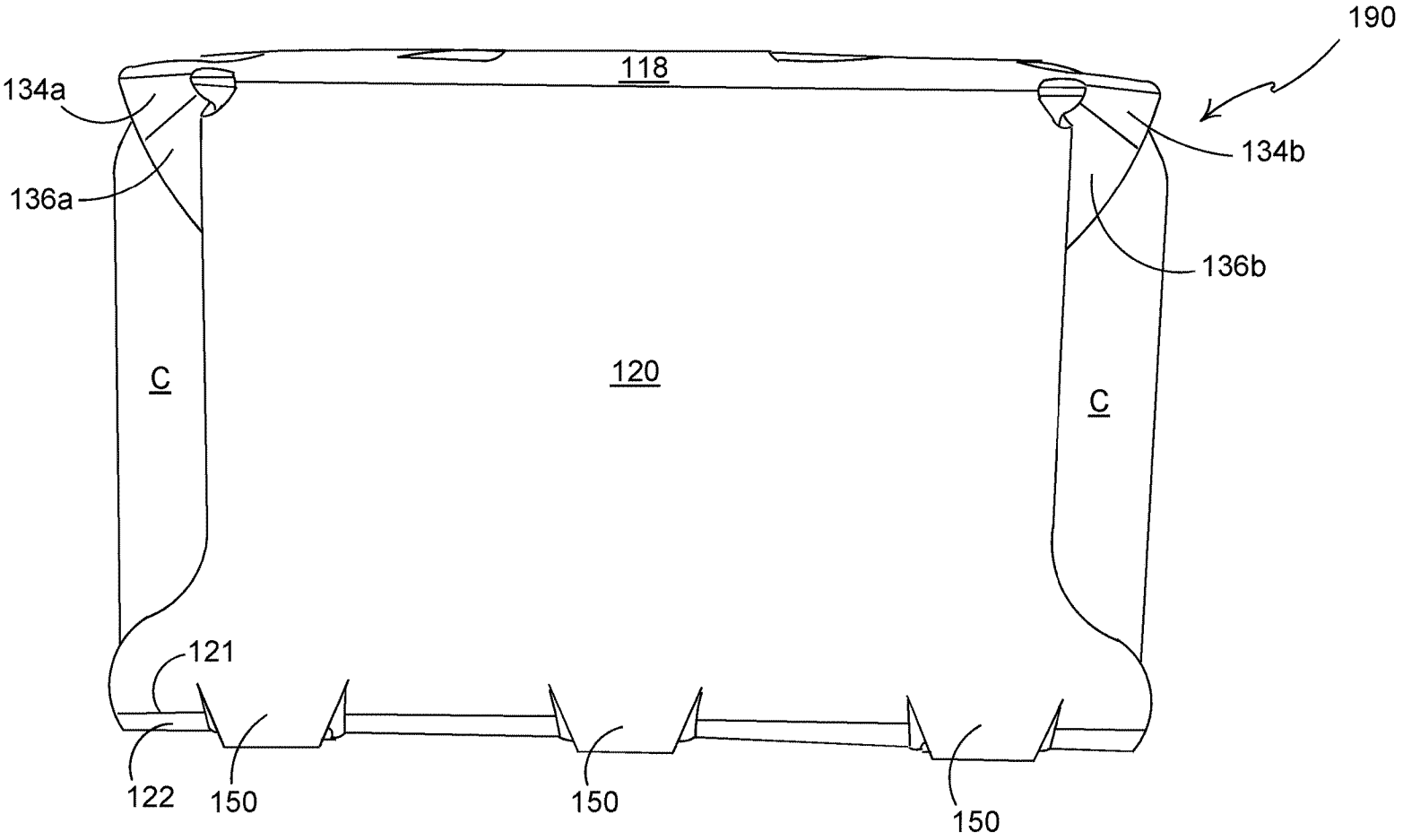
FIG. 8 is a side view of a package comprising a carrier formed from the blank of FIG. 7 and a grouped arrangement of articles secured therein.
Figure 9:
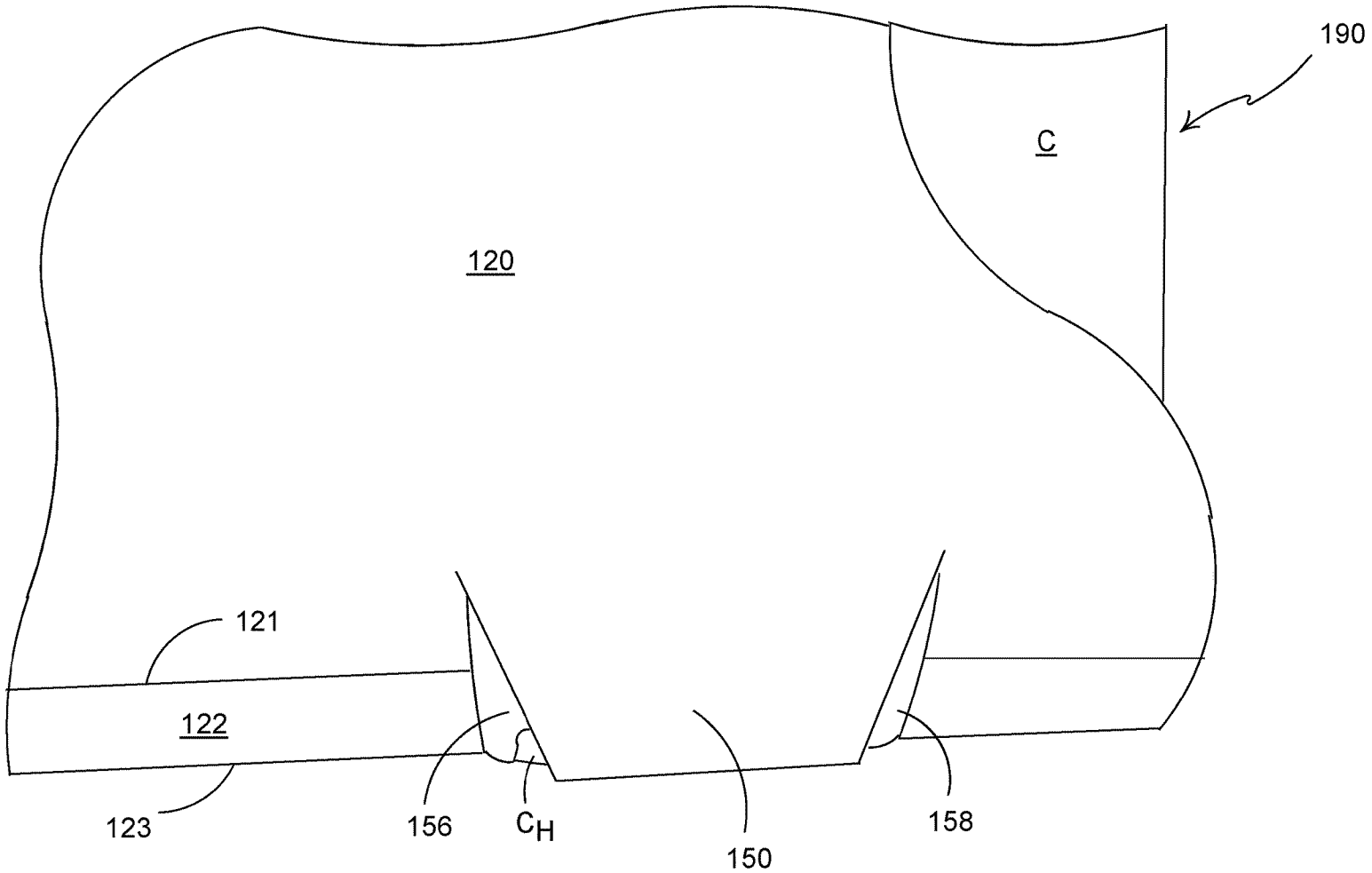
FIG. 9 is an enlarged view of part of the package shown in FIG. 8.

Referring now to FIGS. 7 to 9, there is shown an alternative embodiment of the present invention. In the second illustrated embodiment like numerals have, where possible, been used to denote like parts, albeit with the addition of the prefix "100" to indicate that these features belong to the second embodiment. The alternative embodiment shares many common features with the first embodiment and therefore only the differences from the embodiment illustrated in FIGS. 1 to 6 will be described in any greater detail.

Referring to FIG. 7, the blank 110 comprises a series of primary panels 112, 114, 116, 118, 120, 122, 124 which includes a first bottom panel 112, an optional first bevel panel 114, a first side panel 116, a top panel 118, a second side panel 120, an optional second bevel panel 122 and a second bottom panel 124. The primary panels 112, 114, 116, 118, 120, 122, 124 are hinged one to the next in series by longitudinally extending fold lines 113, 115, 117, 119, 121 and 123.

The first and second bottom panels 112, 124 comprise first and second parts F1, M1 respectively of a mechanical locking mechanism F1/M1 that serves to mechanically join the first bottom panel 112 to the second bottom panel 124 when the blank 110 is folded and formed into a carrier 190 so as to form a composite bottom wall structure 112/124.

The blank 110 may also comprise a carrier opening device T1/T2, which is optionally provided in the top panel 118 and which is optionally formed as a pair of tear lines T1, T2 which define a tear strip therebetween. In other embodiments it is anticipated that the optional carrier opening device T1/T2 may be omitted entirely, or the carrier opening device T1/T2 may take a different form, size, shape and/or position to that shown herein, and/or more than one carrier opening device T1/T2 may be provided. An optional fold line T3 may define in part a tear initiation tab T4 from which the tear strip may be separated from the top panel 118 so that the top panel 118 can easily be split open, relieving the tension of the tightly wrapped carrier 190, and to allow the articles 'C' held within the carrier 190 to be accessed.

The blank 110 also comprises article retention devices L1, L2, L3, L4, L5, L6 for engaging with a bottom of an article 'C'. In the optional arrangement where the blank 110 is configured for forming a carrier 190 for holding six articles in two rows of three articles each, three article retention devices L1, L2, L3 are provided along the first bevel panel 114 between the first bottom panel 112 and the first side panel 116; and a further three article retention devices L4, L5, L6 are provided along the second bevel panel 122 between the second bottom panel 124 and the second side panel 120.

Each article retention device L1, L2, L3, L4, L5, L6 is substantially the same in construction. The article retention devices L1, L2, L3, L4, L5, L6 will be described by reference to the sixth article retention device L6, an enlarged view of which is shown in FIG. 7A.

The sixth article retention device L6 comprises a protection tab 150 and a pair of foldable flaps 156, 158 which help to protect the heel or bottom portion of an article 'C' when partially disposed within an opening formed in part by displacement of the protection tab 150 and the pair of foldable flaps 156, 158. The protection tab 150 and each flap 156, 158 of the pair of foldable flaps 156, 158 are folded outwardly when an article 'C' is received by the sixth article retention device L6. A first foldable flap 156 is hinged to the second bevel panel 122 and to the second side panel 120 by a fold line 157. A second foldable flap 158 is hinged to the second bevel panel 122 and to the second side panel 120 by a fold line 159. An anchor tab 152 is hinged to the second bottom panel 124 by a fold line 151. Optionally, fold line 151 is arcuate in shape; the curved or arcuate shape of the fold line 151 serves to increase the resilient bias of the anchor tab 152 to return to the plane of the second bottom panel 124. In this way the anchor tab 152 is biased against the base of the article 'C' when the article retention device L6 is in use. The anchor tab 152 extends from the fold line 151 to the protection tab 150. The anchor flap 54 provided in the first embodiment is omitted. The anchor tab 152 may comprise optional fold lines 161, 163 for facilitating folding of the anchor tab 152 into or about the base of the article 'C' received by the article retention device L6. In the illustrated embodiment fold lines 161, 163 are defined by cut lines.

The protection tab 150 is longer than the protection tab 50 of the first embodiment of FIG. 1; this can be seen in FIGS. 8 and 9. In this way the protection tab 150 offers increased protection to the article 'C'.

It can be appreciated that various changes may be made within the scope of the present invention. For example, the size and shape of the panels and apertures may be adjusted to accommodate articles of differing size or shape.

As used herein, the terms "hinged connection" and "fold line" refer to all manner of lines that define hinge features of the blank, facilitate folding portions of the blank with respect to one another, or otherwise indicate optimal panel folding locations for the blank. A fold line is typically a scored line, an embossed line, or a debossed line. Any reference to "hinged connection" or "fold line" should not be construed as necessarily referring to a single fold line only; indeed it is envisaged that hinged connection can be formed from any one or more of the following: a short slit, a frangible line or a fold line, without departing from the scope of the invention.

As used herein, the term "severance line" refers to all manner of lines that facilitate separating portions of the substrate from one another or that indicate optimal separation locations. Severance lines may be frangible or otherwise weakened lines, tear lines, cut lines, or slits.

It should be understood that hinged connections, severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

As used herein, the term "wraparound carrier" typically refers to a carrier having four primary walls (top, first side, bottom and second side) that form a sleeve style structure generally having open ends. An article group is tightly wrapped by the carrier which is held in place about the article group by means of a tightly assembled composite top wall or composite bottom wall.

The invention claimed is:

1. A carrier comprising first and second opposed side walls, a bottom wall and a top wall, the carrier comprising at least one article retention device for retaining a portion of an article within the carrier, the at least one article retention device being formed in part from the bottom wall and in part from the first side wall and wherein the at least one article retention device comprises an anchor tab for engaging with an article and first and second protection flaps for protecting the article, the anchor tab and the first and second protection flaps defining an opening in the carrier through which a portion of the article protrudes, wherein the first and second protection flaps are hinged in opposition to each other on opposed sides of the anchor tab, wherein the first and second protection flaps are folded outwardly of the carrier when the article is received by the at least one article retention device.

2. A carrier according to claim 1 wherein the at least one article retention device, when in an unfolded state, completely closes an opening which is defined in the carrier by the at least one article retention device.

3. A carrier according to claim 2 further comprising a first bevel panel disposed between the first side wall and the bottom wall, and wherein the article retention device is struck at least in part from the first bevel panel.

4. A carrier according to claim 3 wherein a protection tab is struck in part from the first bevel panel and in part from the first side wall.

5. A carrier according to claim 4 wherein the first and second protection flaps, the protection tab and the anchor tab completely define the opening such that the at least one article retention device, when in the unfolded state, completely close the opening.

6. A carrier according to claim 4 wherein the first and second protection flaps are hinged in opposition to each other on opposed sides of the protection tab.

7. A carrier according to claim 3 further comprising a second bevel panel disposed between the second side wall and the bottom wall.

8. A carrier according to claim 2 wherein the first and second protection flaps are foldable outwardly in response to receiving an article in the opening.

9. A carrier according to claim 1 wherein the anchor tab is hingedly connected to the bottom wall.

10. A carrier according to claim 1 wherein an anchor flap is hingedly connected to the anchor tab.

11. A carrier according to claim 1 wherein the anchor tab is hingedly connected to the bottom wall by a non-linear fold line.

12. A carrier according to claim 11 wherein the non-linear fold line is arcuate in shape.

13. A carrier according to claim 1 wherein the bottom wall comprises a composite bottom wall and wherein the top wall is foldably adjoined to each of the first and second opposed side walls and formed from a single panel of material.

14. A blank for forming a carrier, comprising panels for forming a first side wall and a second opposed side wall, a bottom wall and a top wall, the blank comprising at least one article retention device for retaining a portion of an article, the at least one article retention device being formed in part from the panel forming the bottom wall and in part from the panel forming the first side wall and wherein the at least one article retention device comprises an anchor tab for engaging with an article and first and second protection flaps for protecting the article, the anchor tab and the first and second protection flaps, when folded, defining an opening through which a portion of the article may protrude, wherein the first and second protection flaps are hinged in opposition to each other on opposed sides of the anchor tab, wherein the at least one article retention device, when in an unfolded state, completely closes said opening.

15. A blank according to claim 14 wherein the anchor tab is hingedly connected to the panel for forming the bottom wall.

16. A blank according to claim 14 wherein an anchor flap is hingedly connected to the anchor tab.

17. A blank according to claim 14 further comprising a panel for forming a first bevel panel disposed between the panels for forming the first side wall and the bottom wall, and wherein the article retention device is struck at least in part from the panel for forming the first bevel panel.

18. A blank according to claim 17 wherein a protection tab is struck in part from the panel for forming the first bevel panel and in part from the panel for forming the first side wall.

19. A blank according to claim 18 wherein the first and second protection flaps, the protection tab and the anchor tab completely define the opening in the blank such that the first and second protection flaps, the protection tab and the anchor tab, when in the unfolded state, completely close the opening.

* * * * *